US006561495B2

(12) United States Patent
Woody

(10) Patent No.: US 6,561,495 B2
(45) Date of Patent: May 13, 2003

(54) CARBURETOR FUEL PRIMING PUMP WITH INTEGRAL FUEL BOWL DRAIN

(75) Inventor: John C. Woody, Caro, MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/970,228

(22) Filed: Oct. 3, 2001

(65) Prior Publication Data

US 2003/0062633 A1 Apr. 3, 2003

(51) Int. Cl.[7] ..... F02M 1/16
(52) U.S. Cl. ..... 261/37; 123/179.11; 261/DIG. 8
(58) Field of Search ..... 261/37, 35, 65, 261/DIG. 8, DIG. 67, DIG. 73; 123/179.11

(56) References Cited

U.S. PATENT DOCUMENTS

| | | | | | |
|---|---|---|---|---|---|
| 1,814,118 | A | * | 7/1931 | Bracke | 261/72.1 |
| 3,233,652 | A | * | 2/1966 | Phillips | 123/179.11 |
| 4,375,206 | A | * | 3/1983 | Baltz et al. | 123/179.11 |
| 4,375,795 | A | * | 3/1983 | Billingsley | 123/179.8 |
| 4,793,951 | A | * | 12/1988 | Scott | 261/35 |
| 4,811,901 | A | * | 3/1989 | Stevens et al. | 239/138 |
| 4,814,114 | A | * | 3/1989 | Charmley | 261/35 |
| 4,824,613 | A | * | 4/1989 | Scott et al. | 261/35 |
| 4,934,601 | A | * | 6/1990 | Stevens et al. | 239/138 |
| 5,740,781 | A | * | 4/1998 | Scott et al. | 123/437 |
| 5,750,056 | A | * | 5/1998 | Pitman et al. | 261/37 |
| 6,029,619 | A | * | 2/2000 | Mitchell | 123/179.11 |
| 6,374,782 | B2 | * | 4/2002 | Ishikawa et al. | 123/73 AF |

FOREIGN PATENT DOCUMENTS

| | | | | |
|---|---|---|---|---|
| JP | 55-142951 | A | * 11/1980 | 261/DIG. 8 |
| JP | 1-178758 | A | * 7/1989 | 261/DIG. 8 |

* cited by examiner

*Primary Examiner*—Richard L. Chiesa
(74) *Attorney, Agent, or Firm*—Reising, Ethington, Barnes, Kisselle, Learman & McCulloch, P.C.

(57) ABSTRACT

A carburetor with a manual priming pump having an integrated fuel drain which provides both the engine manufacturer and end user with an easy way to drain fuel from a fuel chamber of the carburetor. The priming pump has a pump chamber defined by a resilient priming bulb. The pump chamber generally communicates between the fuel chamber and a fuel-and-air mixing passage of the carburetor body and is preferably positioned above the fuel chamber. The dual function of the manual priming pump, prime or drain, is switched by a valve with a rotatable selector member received between a seat and the resilient priming bulb of the pump. The selector member moves between a drain position and a priming position thus enabling draining of the fuel chamber or priming of the carburetor via successive manual depressions of the priming bulb.

45 Claims, 9 Drawing Sheets

CARBURETOR FUEL PRIMING PUMP WITH INTEGRAL FUEL BOWL DRAIN

FIELD OF THE INVENTION

This invention relates to a carburetor for a combustion engine and more particularly to a carburetor having a priming pump with an integral fuel bowl drain.

BACKGROUND OF THE INVENTION

Carburetors, especially those found on small engines such as garden equipment, small outboard motors and utility engines commonly have a primer, which is used to supply fuel from the carburetor to the engine prior to starting the engine, and a bowl drain which is a valve or tube used to drain the fuel from the carburetor bowl. The bowl drain is independent or separate from the primer and is required to drain the bowl of fuel for shipping, maintenance, and engine storage purposes. Two common primer types are a liquid fuel primer and an air pressure primer. The liquid fuel primer injects or pumps a quantity of liquid fuel from the carburetor bowl into the engine intake manifold. The air pressure primer pumps a quantity of air into the space existing above the level of fuel within the carburetor bowl. This air momentarily pressurizes the air space thus forcing some of the liquid fuel from the bowl through the carburetor main nozzle and into the engine intake manifold.

The liquid fuel primer is more expensive than the air pressure primer however it is preferable for larger engines, cold weather applications, and more experienced operators. Directly injecting liquid fuel requires less actuations of the priming bulb for a given quantity of fuel than the air primer. Also with direct fuel injection, the fuel can be placed more accurately into a given area of the carburetor or engine intake. The less expensive air pressure primer has a greater margin of error on the number of depressions or primes, but it still works well on small engines used primarily in warm weather, such as a walk behind lawn mower.

One common type of bowl drain has a fitting normally attached near the top of the carburetor that is connected to a tube extending to the bottom of the carburetor bowl and is normally used by the engine or equipment manufacturer to evacuate the fuel from the bowl of the carburetor after initial testing of the engine at the factory prior to shipment. This is accomplished by putting a suction hose on the fitting and drawing the fuel from the bowl. The fitting is then sealed to prevent contaminants from entering the bowl. This type of bowl drain is ideal for a manufacturing environment having an adequate suction source, because the bowl can be drained in a few seconds as opposed to the much slower gravity drain. Unfortunately, this type of tube bowl drain is of little use to the end user for draining the bowl since the end user seldom has the right size hose and a vacuum source suitable for drawing gasoline from the bowl. A second typical bowl drain has a manually operated valve at or near the bottom of the carburetor bowl which when opened allows the fuel to drain via gravity from the bowl. This second or valve-type of bowl drain is much better suited to the end user of the equipment, but can be inadvertently left open resulting in fuel spill and the inability to start the engine until the valve is manually closed. Moreover, the valve-type of bowl drain requires extra parts leading to higher manufacturing costs.

SUMMARY OF THE INVENTION

This invention provides a carburetor with a manual priming pump having an integrated carburetor fuel drain which provides both the engine manufacturer and end user with an easy way to drain fuel from a fuel chamber of the carburetor. The priming pump has a pump chamber defined by a resilient priming bulb. The pump chamber generally communicates between the fuel chamber and a fuel-and-air mixing passage of the carburetor body and is preferably positioned above the fuel chamber. The dual function of the manual priming pump, prime or drain, is switched by a valve with a rotating member engaged sealably between a seat and the resilient priming bulb of the pump. The member moves between a drain position and a priming position thus enabling draining of the fuel chamber or priming of the carburetor via successive manual depressions of the priming bulb.

The member is preferably a rotating disk having a drain fuel-in orifice and a drain fuel-out orifice which when the member is in the drain position align respectively to a fuel draw passage and a fuel drain passage both preferably defined in-part by the carburetor body. The fuel draw passage communicates with the fuel chamber and the fuel drain passage communicates with the environment external to the carburetor. Both passages communicate with the pump chamber when the member is in the drain position, but only the fuel draw passage communicates with the pump chamber when the member is in the priming position. The priming pump may be of either the liquid fuel direct injection or the air pressure type. Either type can be mounted directly on the carburetor body or remotely, such as on an air filter or an engine housing.

Objects, features and advantages of this invention include providing a carburetor priming pump which is also capable of draining the carburetor fuel bowl. The novel priming pump simplifies draining of the fuel bowl for the end user. The invention provides an extremely compact construction and arrangement, a relatively simple design, extremely low cost when mass produced and is rugged, durable, reliable, requires little to no maintenance and in service has a long useful life.

BRIEF DESCRIPTION OF THE DRAWINGS

These and other objects, features and advantages of this invention will be apparent from the following detailed description, appended claims and accompanying drawings in which:

DETAILED DESCRIPTION OF THE PREFERRED EMBODIMENTS

Figure 1:
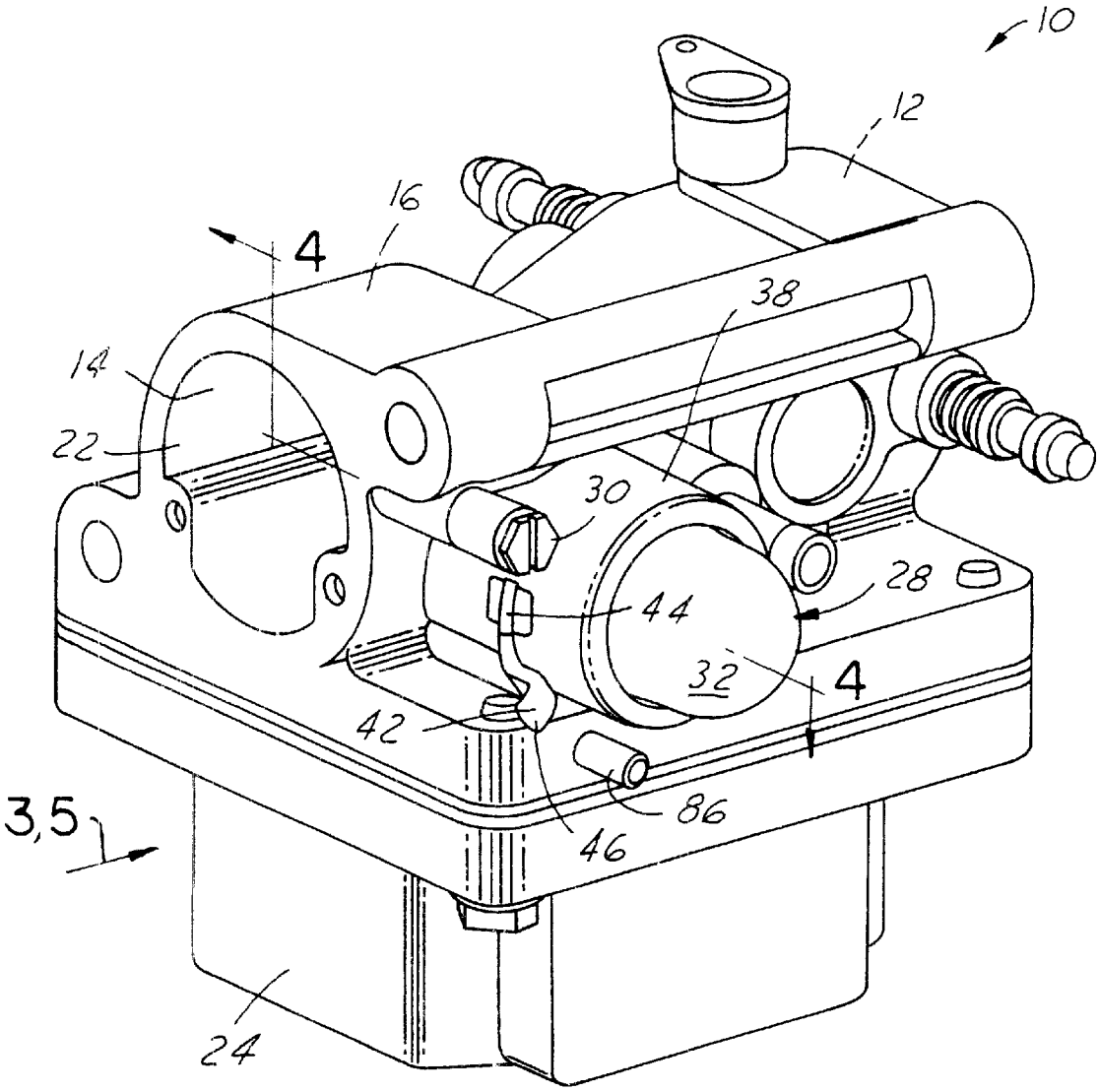
FIG. 1 is a perspective view of a carburetor having a fuel priming pump of the present invention.
Figure 2:
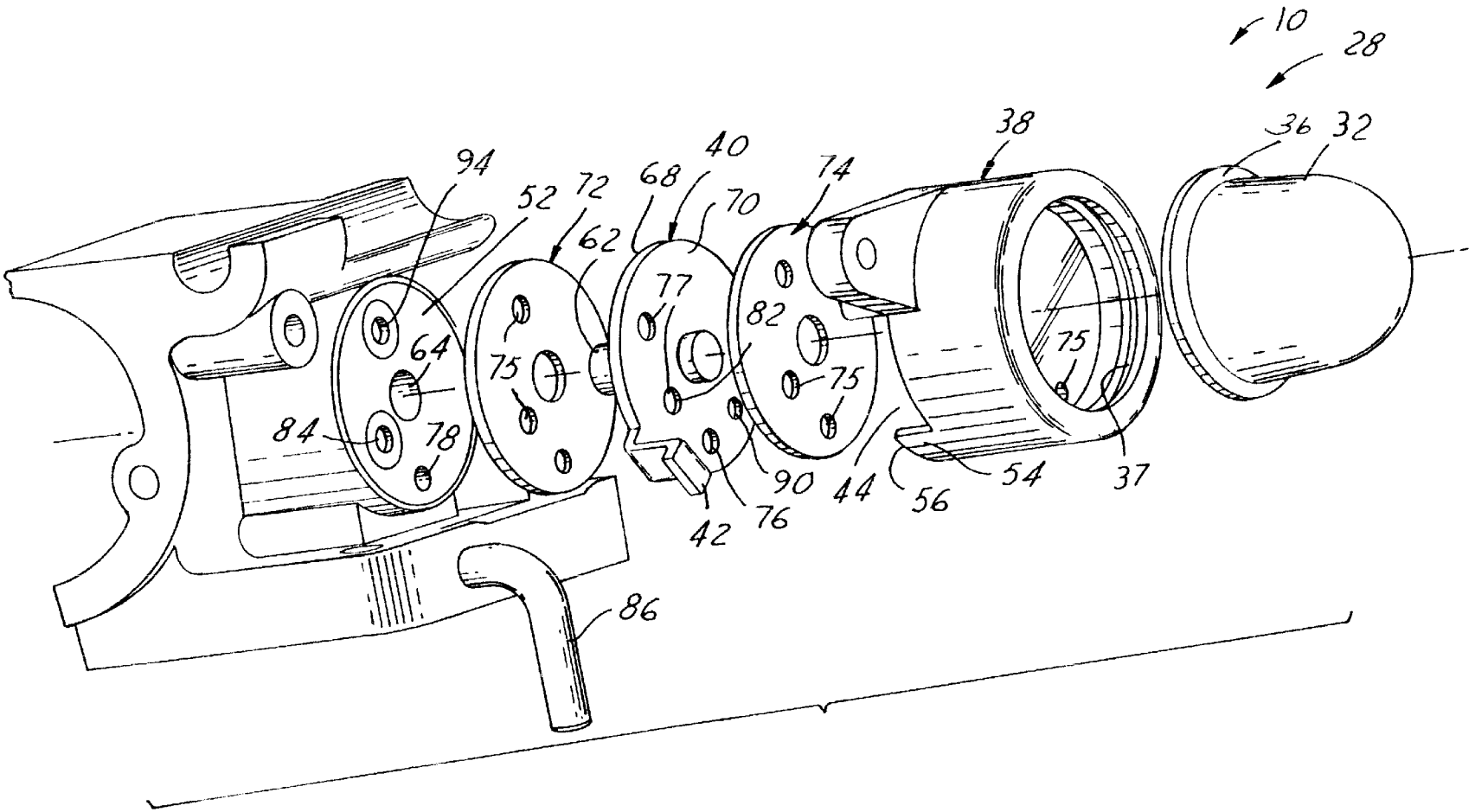
FIG. 2 is an exploded perspective view of the fuel priming pump.
Figure 3:
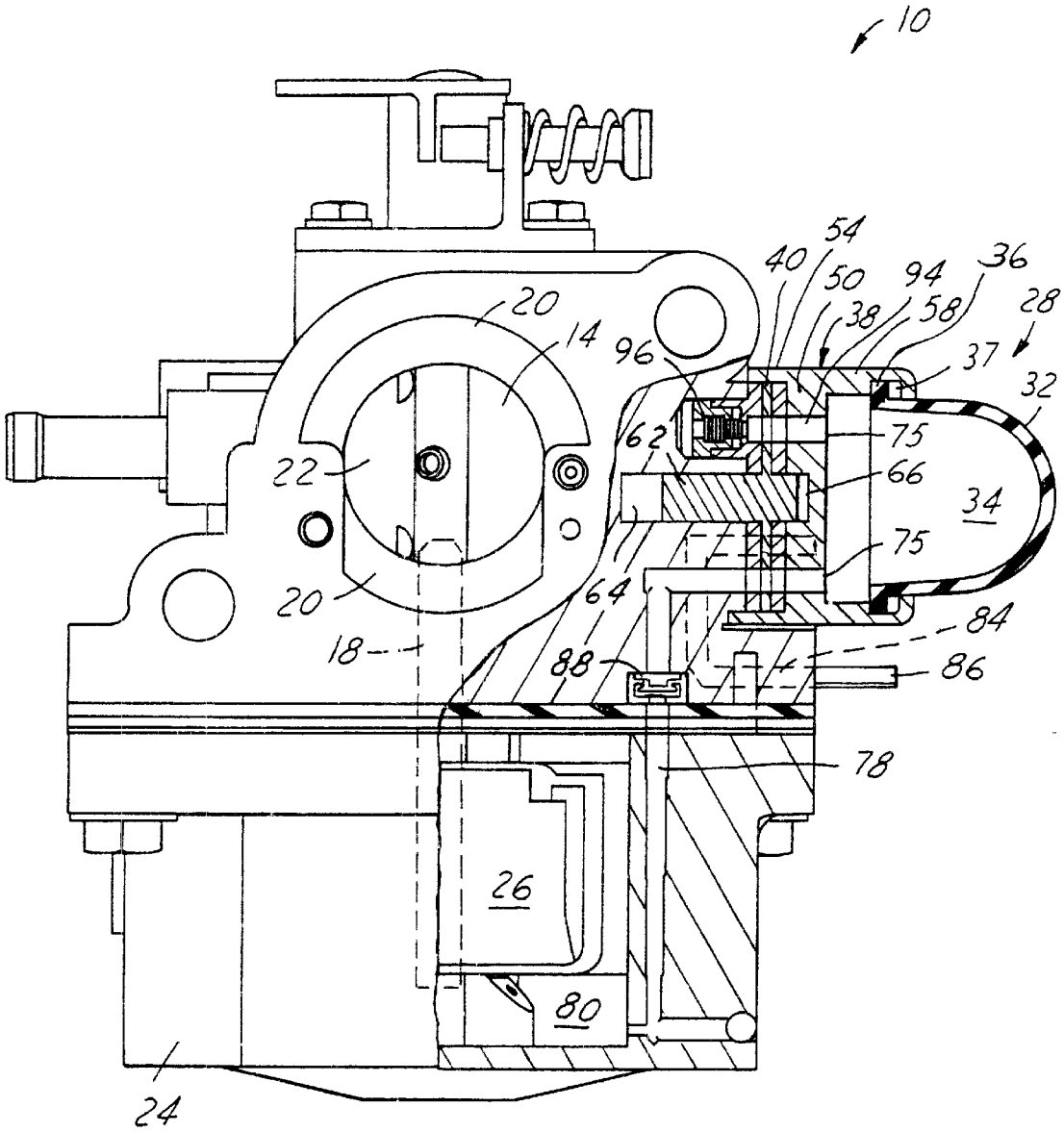
FIG. 3 is an end view of the carburetor taken in the direction of arrow 3 of FIG. 1 with parts broken away and in a section to show internal detail.

Referring in more detail to the drawings, FIGS. 1, 2 and 3 illustrate a carburetor 10 for a combustion engine (not shown) embodying this invention. In operation, air enters an inlet 22 of a fuel-and-air mixing passage 14 defined by a carburetor body 16 of the carburetor 10. Fuel enters the fuel-and-air mixing passage 14 via a main fuel feed passage 18 having a nozzle disposed in the region of a venturi 20 within the passage 14. The fuel mixes with the air and exits the carburetor 10 at an outlet 12 of the fuel-and-air mixing passage 14 where the mixture then flows into an engine combustion chamber (not shown). Fuel enters the main fuel feed passage 18 from a fuel chamber 26 of the carburetor 10 defined by a fuel bowl 24 engaged sealably to the underside of the carburetor body 16, and preferably with a sealing gasket there-between. During normal running conditions of the combustion engine, the fuel-and-air mixing passage is at sub-atmospheric pressure and the fuel chamber 26 is near atmospheric pressure. Fuel is thus forced to flow up through the nozzle of the main fuel feed passage 18 and into the fuel-and-air mixing passage 14. When the engine is not running, for example, before attempting to start the engine, a vacuum does not exist within the fuel-and-air mixing passage 14 and an alternative means must be provided to supply fuel to the combustion chamber. A manual priming pump 28 is one such alternative means and is engaged to the carburetor body 16 via a plurality of threaded fasteners 30.

The priming pump 28 has a resilient priming bulb 32 which defines a pump chamber 34. In preparation for starting of the engine, manual operation of the priming pump 28 is achieved by depressing the priming bulb 32 with a force greater than its own resilience. Release of the bulb 32 will cause it to return, or unflex, to its natural state, causing fuel and/or air to flow through a series of passages and check valves. This flow assures that necessary fuel enters the fuel-and-air mixing passage 14 for starting of the engine. To induce flow, a sub-atmospheric pressure or suction is applied to these passages via the bulb 32 which is leak tight relative to the carburetor body 16, as best shown in FIG. 3. To accomplish this seal, a circumferential lip 36 of the bulb 32 substantially projects laterally outward along the bulb's perimeter or distal edge, and is sealably press fitted into a circumferential groove 37 of an encasement 38 which engages the carburetor body 16. The groove 37 is defined by the encasement 38 and communicates radially inward toward the pump chamber 34. The encasement 38 is secured to the carburetor body 16 by the threaded fasteners or bolts 30.

Figure 6:
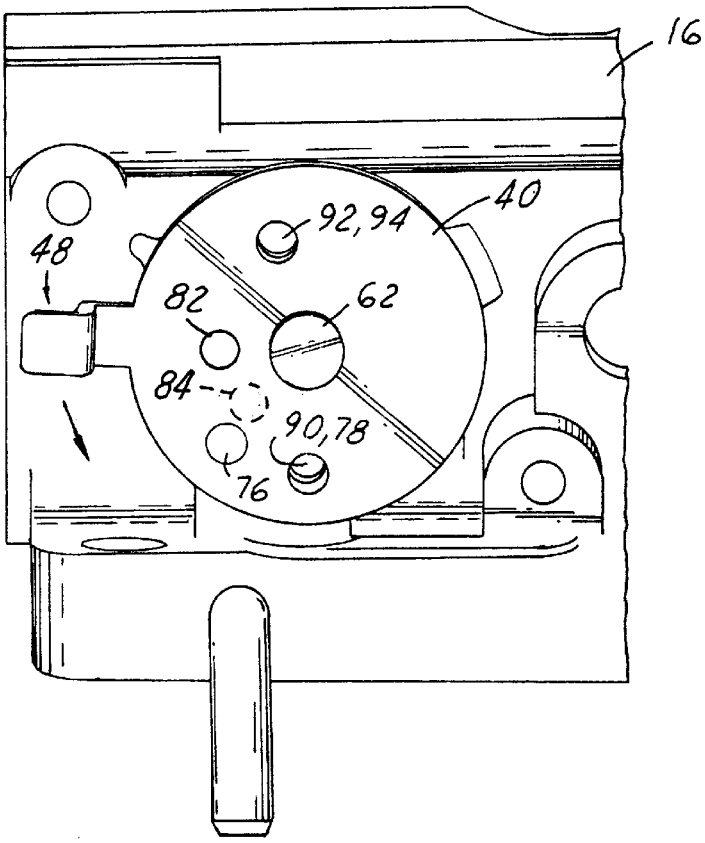
FIG. 6 is a fragmentary side view of the carburetor with parts removed and showing a selector disc in a priming position.
Figure 7:
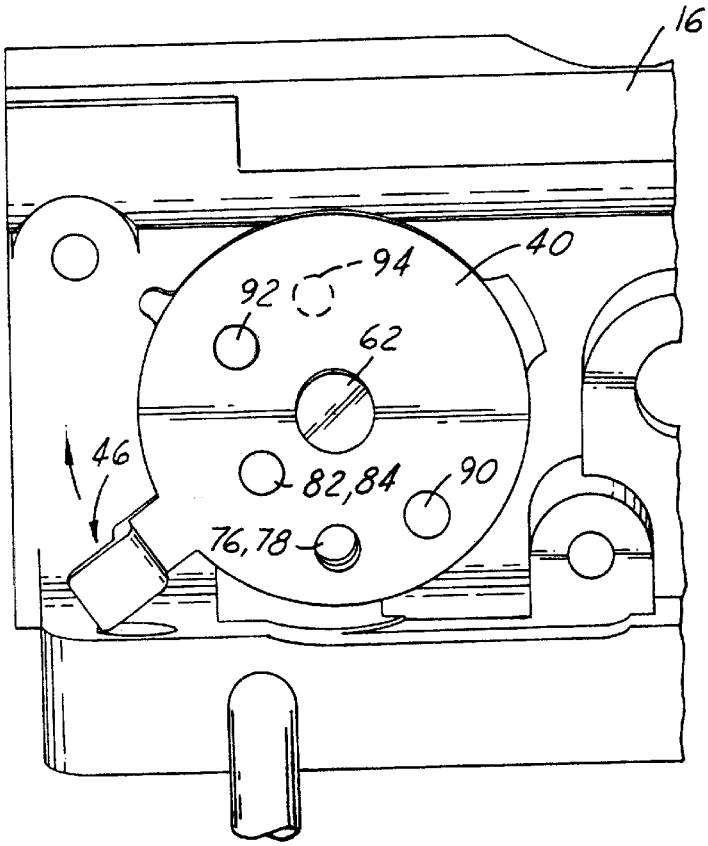
FIG. 7 is a fragmentary side view of the carburetor of FIG. 6 showing the selector disc in a drain position.
Figure 8:
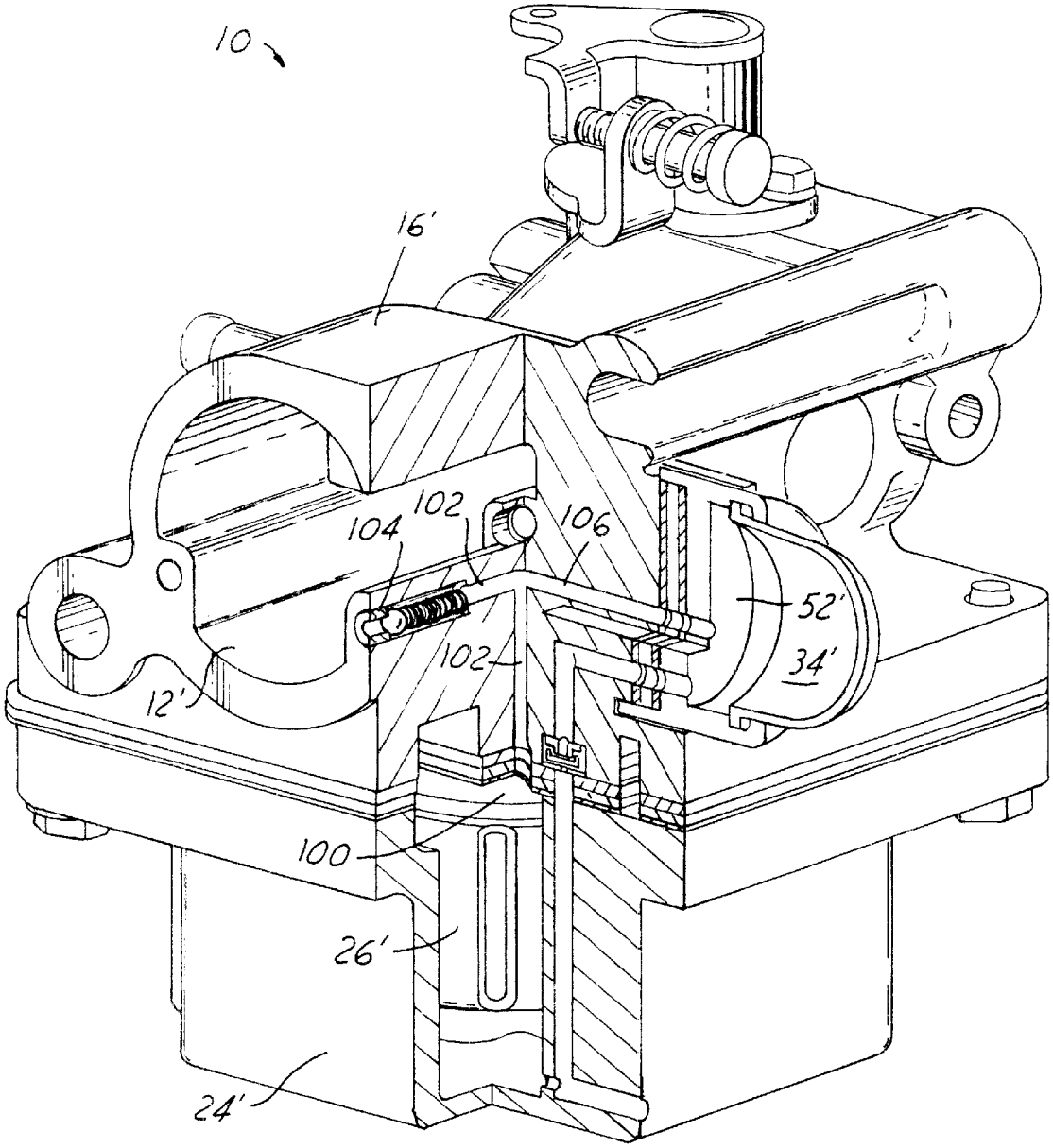
FIG. 8 is a perspective view with portions broken away and in section of a second embodiment of a carburetor of the present invention.
Figure 10:
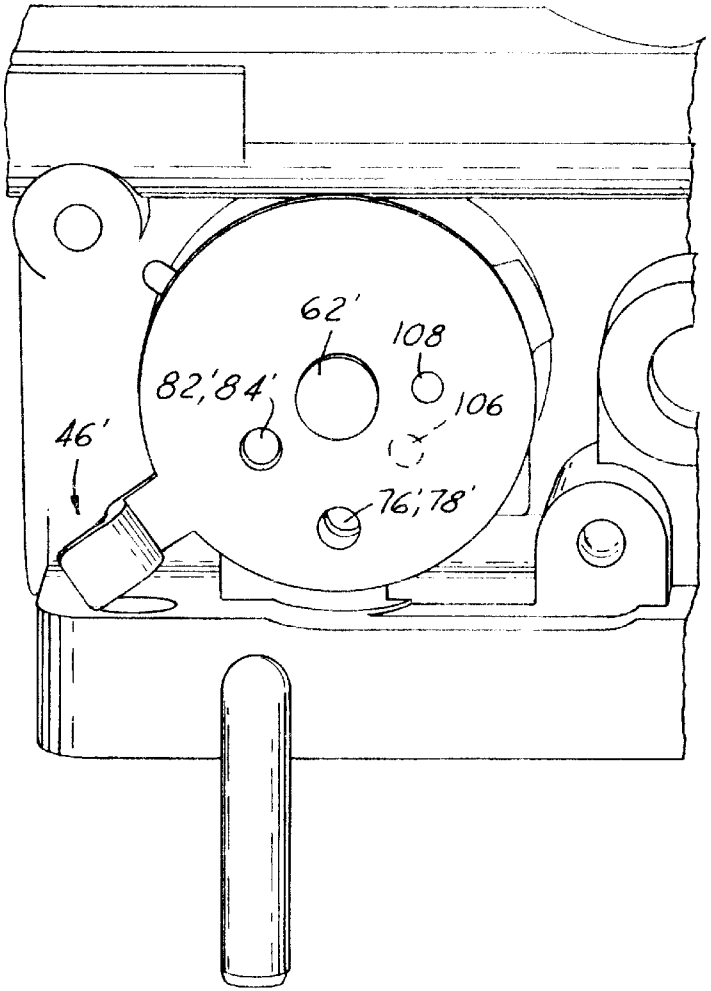
FIG. 10 is a fragmentary perspective view of the carburetor of the second embodiment showing the selector disc in a drain position.

Referring to FIG. 2, integrated into the priming pump 28 is the ability to drain the fuel bowl 24 of fuel without the utilization of a local gravity drain valve or the use of external siphoning equipment. Sandwiched between the encasement 38 and the carburetor body 16 is a planar member or selector disc 40. Disc 40 has a tab 42 which projects through a slot 44 defined by the encasement 38. The disc 40 is moved rotatably, or positioned, via manually grasping the protruding tab 42. A series of orifices communicating axially through the disc 40 align or mis-align with various passages depending on the position of the disc 40. One such passage and orifice alignment will function to prime the carburetor 10 for engine starting when bulb 32 is repeatably depressed and is identified as the prime position 48, as best shown in FIG. 6. And, another passage and orifice alignment will function to drain the fuel chamber 26 by depressing the same bulb 32 and is identified as the drain position 46, as best shown in FIG. 7. Referring to FIG. 1, when tab 42 is in the lower position, or nearest the fuel bowl 24, the disc 40 is in the drain position 46, and when the tab 42 is positioned upward, it is in the prime position 48.

The encasement 38 has a substantially planar midsection 50 disposed parallel to an exterior mating surface or seat 52 of the priming pump 28 and defined by the carburetor body 16. The planar member or disc 40 is substantially of a consistent thickness and is disposed between the seat 52 of the priming pump 28 and the planar midsection 50 of the encasement 38. Projecting axially inward from the midsection 50 of the encasement 38 is a cylindrical or circumferential wall 54 which has a distal edge 56 that engages the perimeter of the seat 52 defined by the carburetor body 16. Projecting axially outwardly is a second cylindrical or circumferential wall 58 wherein the groove 37 which receives the lip 36 of the priming bulb 32 is formed. The pump chamber 34 is ultimately defined by the priming bulb 32, the second circumferential wall 58 and an outward surface of the planar midsection 50.

To stabilize or enhance rotation of the disc 40, a pin or shaft 62 concentrically extends through and unitarily engages the disc 40. The shaft 62 rotatably fits within a bore 64 defined by the seat 52 or the carburetor body 16 at one end, and a bore 66 defined by the encasement 38 on the outward side of the disc 40 at the other end. The disc 40 has an inward side 68 and an opposite outward side 70. The inward side 68 slideably and sealably engages against an inward gasket 72 disposed between the seat 52 and the disc 40. Likewise, an outward gasket 74 reduces friction and seals between the outward side 70 of the disc 40 and the encasement 38. The inward and outward gaskets 72, 74 are disposed radially inward from the circumferential wall 54 of the encasement 38. The inward and outward gaskets 72, 74 are substantially identical to one-another, both being annular in shape and having a pattern of holes 75 which align with various passages communicating through the seat 52 defined by the carburetor 16. Likewise, the planar midsection 50 of the encasement 38 will have the same pattern of holes 75. As the disc 40 rotates relative to the adjacent gaskets 72, 74, a series of orifices 77, axially penetrating the disc 40, will align or misalign with the designated holes 75 thereby allowing the associated passages to communicate with the pump chamber 34 or be obstructed from doing so.

Figure 4:
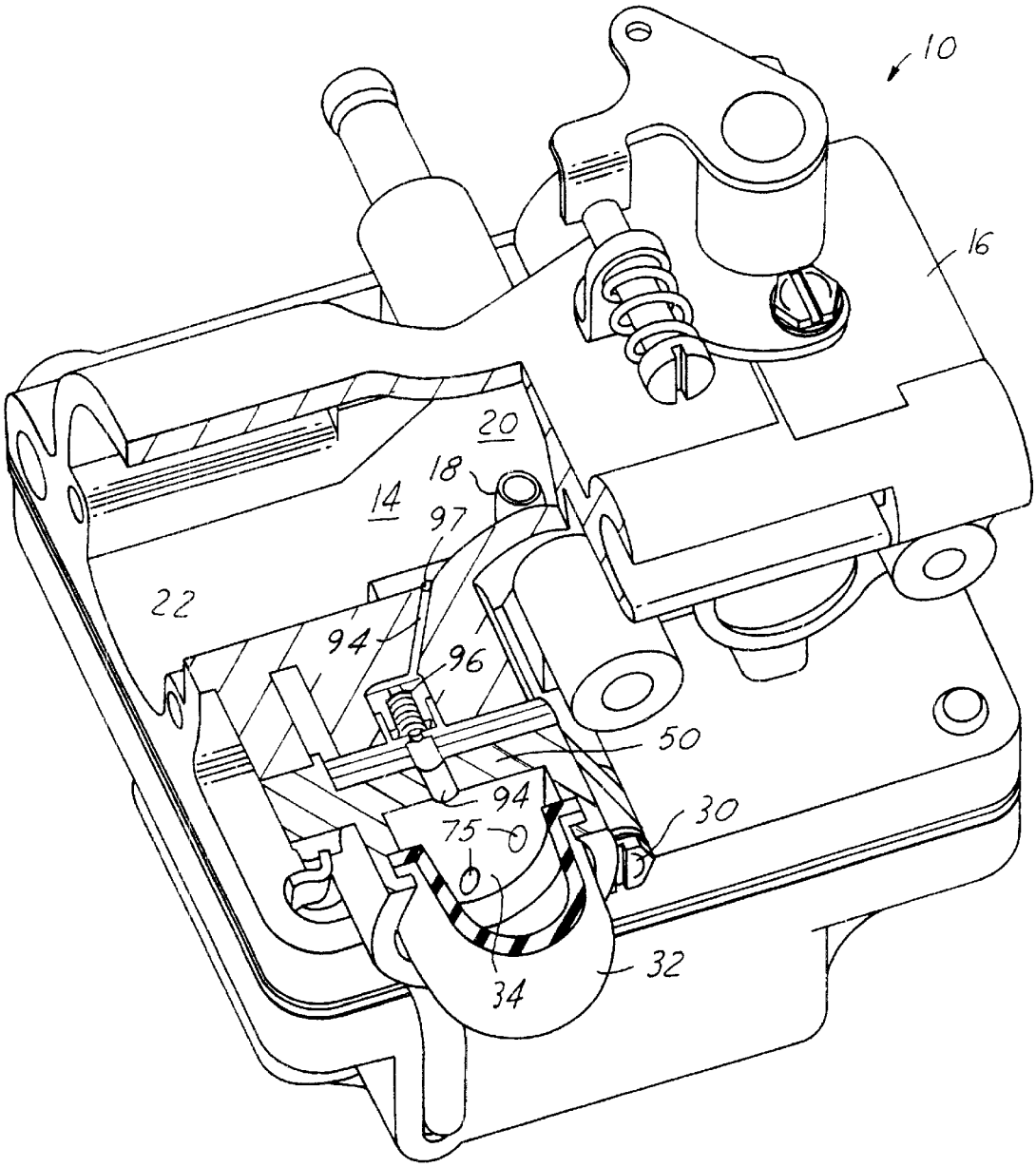
FIG. 4 is a perspective view of the carburetor with parts broken away in a section taken generally along line 4—4 of FIG. 1 to show internal detail.

Referring to FIGS. 2, 4 and 7, when disc 40 is rotated to the drain position 46, a drain fuel-in orifice 76, extending axially through the disc 40, aligns with a fuel draw passage 78 defined by the carburetor body 16. The fuel draw passage 78 extends from a lower portion 80 of the fuel chamber 26 to and through the seat 52. Similarly, a drain fuel-out orifice 82 through the disc 40 communicates with a drain passage 84 defined by the carburetor body 16 which extends between a tube or nozzle 86 disposed externally to the carburetor body 16 and through the seat 52. When operating the priming pump 28 in drain position 46, the resilient priming bulb 32 is manually depressed or flexed, causing fuel to flow through a check valve 87 disposed in the drain passage 84 and located near or flush with the seat 52 of the carburetor body 16. The fuel then flows out of the carburetor 10 through the external tube 86. When the priming bulb 32 is released, the resilience of the bulb 32 causes it to return outwardly, or unflex, to a natural or preformed state, thereby producing a vacuum within the pump chamber 34 causing fuel to flow through the fuel draw passage 78 and through a check valve 88 disposed therein. This manual process must be repeated until the fuel bowl 24 is completely drained of fuel unless the tube 86 extends below the lower portion 80 of the fuel chamber 26. If tube 86 does so extend below the bottom 80, a desirable siphoning action will be created by the initial depression(s) of bulb 32 causing the fuel to drain continuously until depleted.

Referring to FIG. 6, when the priming pump 28 is in the priming position 48, the drain fuel-in orifice 76 and the drain fuel-out orifice 82 in the disc 40 are misaligned to the respective fuel draw passage 78 and drain passage 84. Consequently, the drain passage 84 is cut-off, obstructed, or isolated from the pump chamber 34 by the disk 40. However, the fuel draw passage 78 is not obstructed when the priming pump 28 is in the priming position 18 because a second or prime fuel-in orifice 90, communicating axially through the disc 40, becomes aligned with the fuel draw passage 78. Likewise, a fuel prime orifice 92 in the disc 40 is aligned with a fuel prime passage 94 defined by the carburetor body 16.

Referring to FIG. 4, the fuel prime passage 94 is in communication with the fuel-and-air mixing passage 14 via a port 97 disposed substantially near the venturi 20 and between the inlet 12 and venturi 20. So that fuel may only flow from the pump chamber 34 to the fuel-and-air mixing passage 14, a spring loaded check valve 96 is disposed within the fuel prime passage 94 substantially flush to the seat 52. Depressing the bulb 32 will cause fuel located within the pump chamber 34 to flow out past the check valve 96 through the fuel prime passage 94 and into the fuel-and-air mixing passage 14, thereby priming the carburetor 10. Release of the bulb 32 will cause the bulb to expand, or unflex, and return to its preformed shape creating a vacuum which causes fuel to flow from the fuel chamber 26, through the fuel draw passage 78, and into the pump chamber 34.

Figure 5:
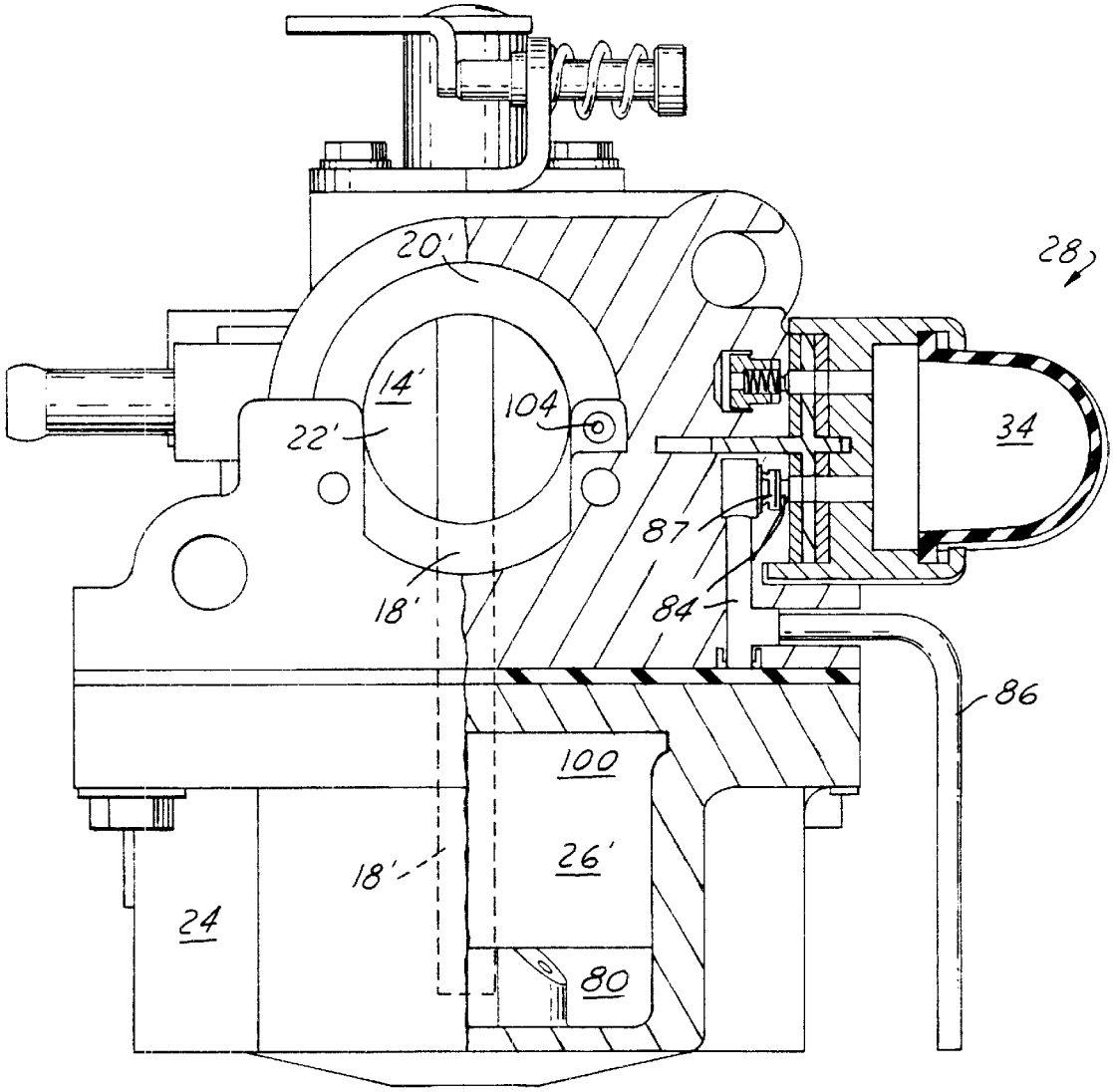
FIG. 5 is a perspective view of the carburetor taken in the direction of arrow 5 of FIG. 1 with parts broken away and in section to show internal detail.

Referring to FIGS. 8–11, a second embodiment of the carburetor 10' of the present invention is shown. In this embodiment, the disc 40' has a drain position 46' oriented similarly to the first embodiment, however, a priming position 48' has an orientation different than the first embodiment. In the second embodiment, when the disc 40' is in the priming position 48', fuel no longer flows through the fuel passage 94 of the first embodiment, instead, the fuel flows through a main feed passage 18', as best shown in FIG. 5, by pressurizing an upper air dome portion 100 of the fuel chamber 26'.

Under normal running conditions, the fuel chamber 26' is under near atmospheric pressure conditions via a vent passage 102 which extends from the upper air dome portion 100 of the fuel chamber 26' to a biased normally closed vent check valve 104 disposed near the inlet 22' of the fuel-and-air mixing passage 14'. During running conditions of the engine, fuel flows out of the fuel chamber 26' via the main feed passage 18'. Also, when the engine is running, the vibration or shaking forces produced by the operating engine cause a ball 109 of the vent check valve 104 to dance or move in a counterbore 114 and away from a ball seat 110 against a biasing force of coil spring 112 so that the passage 102 communicates with the atmosphere through the orifice 117. The ball seat 110 is slideably received in the open end of a tubular body 113 with a closed end 116 having a port 115 communicating with the vent passage 102. Preferably the body 113 is press fit in a counterbore 114 in the carburetor body at the end of the vent passage 102. The bore 114 of the tubular body has a larger inside diameter than the outside diameter of the ball to permit fluid to pass between them. The ball seat 110 is press fit in the body 13 and has a vent orifice 117. When the vent check valve ball 109 moves away from the seat 110 within the bore 114, the spring 112 compresses axially against the end 116. When the engine is not running, the ball 109 of the vent check valve 104 is forced back against the ball seat 110 by the spring 112, thereby closing or blocking off the vent orifice 117.

Figure 9:
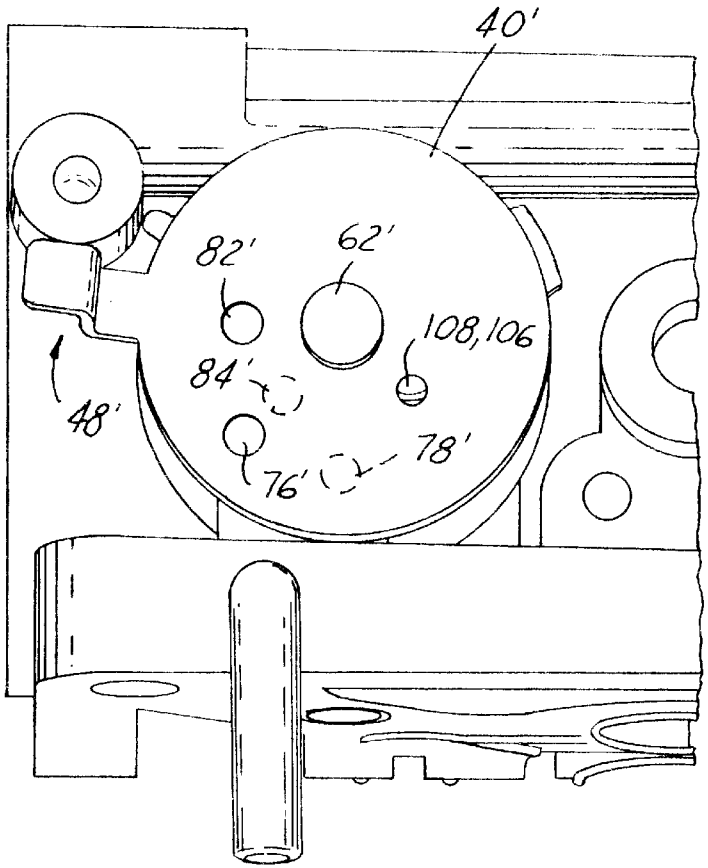
FIG. 9 is a fragmentary perspective view of the second embodiment of the carburetor showing a selector disc in a priming position and with parts of the priming pump removed to show internal detail.
Figure 11:
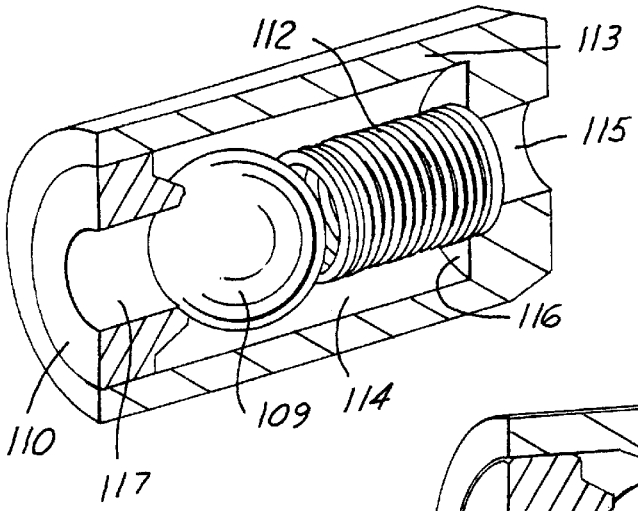
FIG. 11 is an enlarged perspective view with portions broken away and in section of a vent check valve taken from FIG. 8.

An air prime passage 106 communicates between the vent passage 102 and the pump chamber 34', and through the seat 52'. When the disc 40' is in the priming position 48', as best shown in FIG. 9, an air prime orifice 108 of the disc 40' aligns with the air prime passage 106, and amounts to the only communication from the pump chamber 34' through the disc 40' when in the priming position 48'. In operation, depressing the bulb 32' will cause air to flow through the air prime passage 106 and into the vent passage 102 with all of the air flowing into the upper air dome portion 100 of the fuel chamber 26' because the vent check valve 104 is closed. This creates a sufficient pressure surge, within the fuel chamber 26' so that fuel flows upward through the fuel feed passage 18' and into the fuel-and-air mixing passage 14', as best shown in FIG. 5. If the cross section of the vent orifice 117 is substantially smaller than the flow cross section of the vent passage 102 and smaller than the flow cross section of the air prime passage 106, the ball 109 and the spring 112 of the vent check valve 104 are not absolutely necessary for the priming pump 28' to work. This is so because only a small amount of air will escape through the vent orifice 117 while the majority enters and pressurizes the air dome portion 100 of the fuel chamber 26'.

Figure 12:
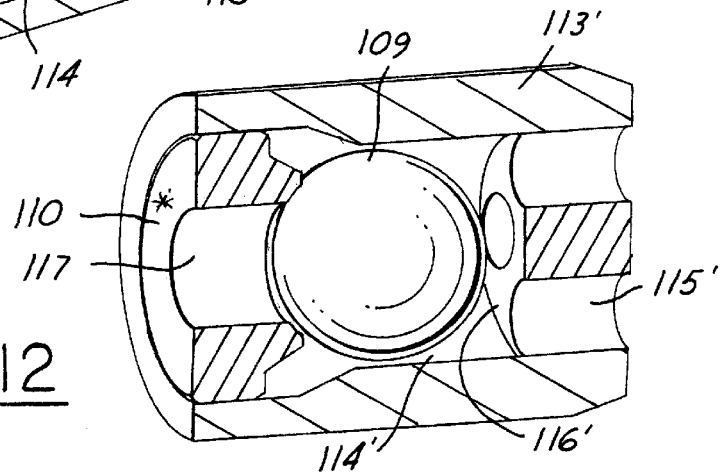
FIG. 12 is an enlarged perspective view with portions broken axially and in section of a modified check valve.

FIG. 12 illustrates an alternative check valve 104' which may be used in lieu of check valve 104. The ball 109 of the check valve 104' is freely movable between the seat 110 and the end wall 116' of its body 113' and the end wall has a plurality of radially and circumferentially spaced-apart ports 115' which communicate with the vent passage 102 when the body 113' is press fit therein. The clearance between the bore 114' and the ball 109 and the mass of the ball is sized and calibrated so that regardless of the orientation of the check valve 104', the pressure pulses produced in the passage 102 by pressing the pump bulb 32 force the ball 109 onto its seat 110 to close the vent passage 117 and the sub-atmospheric pressure produced by release of the bulb 32 produces an in-rush of air through the orifice 117 which unseats the ball 109 so that incoming air flows around the ball and into the passage 102. When the engine starts, the vibration or shaking forces produced by the operating engine cause the ball 109 to dance or move in the bore 114' away from the seat 110 so that the passage 102 communicates with the atmosphere through the orifice 117. The construction of check valve 104' eliminates the need for any compression spring 112 and ensures that the ball 109 will be unseated so that the vent passage 102 communicates with the atmosphere while the engine is operating.

The clearance between the ball 109 and the bore 114, and the mass or weight of the ball can be readily designed so that even if the valve assembly 104' is oriented with its axis extending vertically and the seat 110 is at the upper end, the ball 109 will be moved upward and bear on its seat 110 due to the force of air acting on and moving past the ball produced by depressing the pump bulb 32. Conversely, even if the valve assembly 104' is oriented with its axis extending vertically and the seat 110 at the lower end with the ball resting thereon, the ball will be moved upward away from the seat to open the valve by the force of incoming air through the vent 117 produced by release of the pump bulb 32. In all orientations, when the engine is running, the vibration or shaking forces of the engine will keep the ball 109 unseated so that it will not inhibit communication of the passage 102 with the external atmosphere and the normal function of the bowl drain. Preferably, the valve assembly 104' is oriented so that in the normal resting orientation of the carburetor, when the engine is not operating, the ball 109 will bear on the seat 110 to further reduce diurnal vapor emission.

Figure 13:
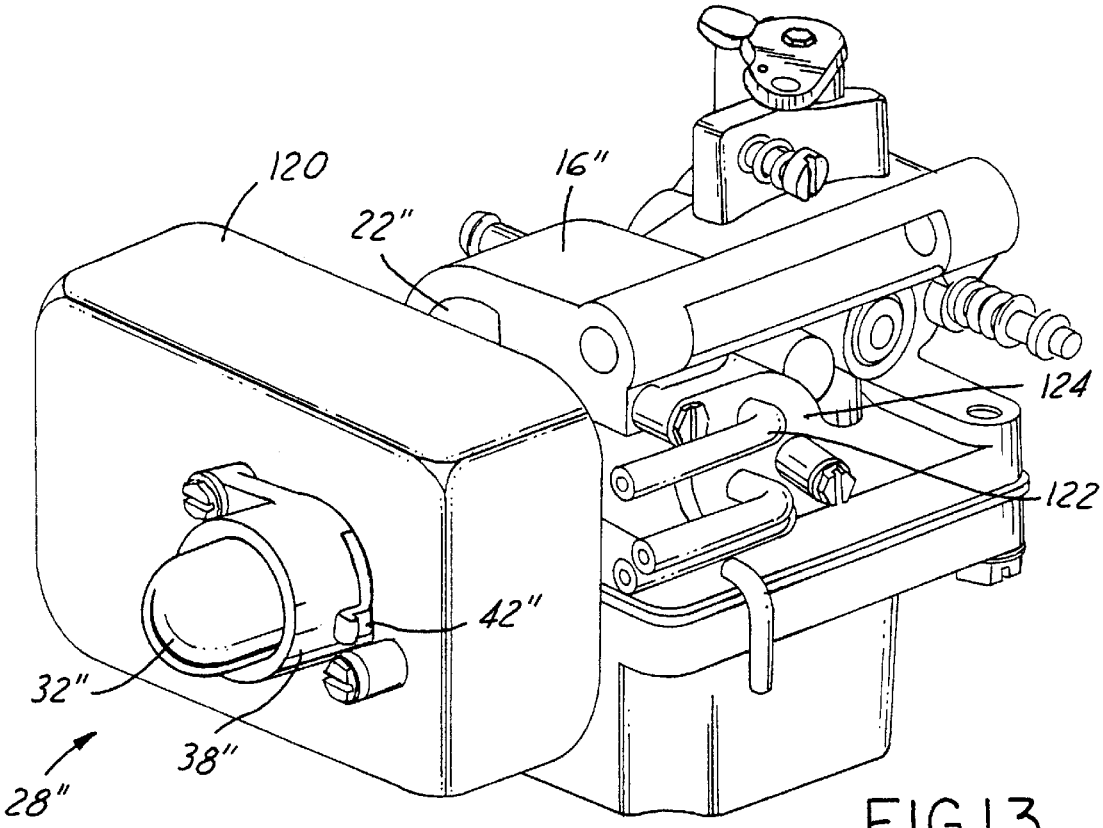
FIG. 13 is an exploded perspective view of a modification of the carburetor showing a priming pump mounted on an air cleaner.

As best shown in FIG. 13, a modification of the present invention has the priming pump 28" mounted, remote from the carburetor body 16", and onto an air cleaner housing 120. Depending upon the engine application, this orientation may be preferred if the carburetor body 16" is not readily accessible to the end user. A series of tubes 122 are supported between the air cleaner housing 120 and a flange 124 which fasten to the carburetor body 16". The seat 52" (not shown) is not defined by the carburetor body 16" as it is for the first and second embodiments. Instead, the seat 52" is defined by the air cleaner housing 120 or an additional section of the encasement 38".

While the forms of the invention herein disclosed constitute presently preferred embodiments, many others are possible. For instance, the carburetor body 16 may include all the features of the first and second embodiments. That is, a carburetor body can include the air prime passage 106 specific to the second embodiment and the fuel prime passage 94 specific to the first embodiment. The priming pump 28' can be provided as a kit assembly wherein the disc 40 of the first embodiment and the disc 40' of the second embodiment along with the associated gaskets are both provided within the kit. The choice of an air priming pump 28' or a fuel priming pump 28 is then left to the end carburetor assembler who is supplied with the generic carburetor body and the kit.

Alternatively, the end carburetor assembler may be supplied with the generic carburetor body, and either the disc 40 or 40' depending on the desired end use of the carburetor. It is not intended herein to mention all the possible equivalent forms or ramification of the invention. It is understood that terms used herein are merely descriptive, rather than limiting, and that various changes may be made without departing from the spirit or scope of the invention.

What is claimed is:

1. A carburetor for an internal combustion engine, the carburetor having a carburetor body defining a fuel-and-air mixing passage extending through the carburetor body from an inlet communicating with near atmospheric conditions to an outlet communicating with a combustion chamber of the engine, the carburetor comprising:

a carburetor body defining a fuel chamber having a lower portion;

a priming pump constructed and arranged to communicate between the fuel-and-air mixing passage and fuel chamber of the carburetor body, the priming pump having a pump chamber, a resilient priming bulb, a seat, and a selector member, the pump chamber defined at least in part by the priming bulb, the selector member being received between the priming bulb and the seat and constructed and arranged to move to a priming position and to a drain position, the selector member having a drain fuel-in orifice and a drain fuel-out orifice communicating through the selector member;

a fuel draw passage exposed through the seat and communicating between the lower portion of the fuel chamber and the pump chamber when the drain fuel-in orifice is aligned to the fuel draw passage and the selector member is in the drain position; and a drain passage exposed through the seat and communicating between the pump chamber and atmosphere when the drain fuel-out orifice is aligned to the drain passage and the selector member is in the drain position; and wherein the fuel drain passage is obstructed from communicating with the pump chamber by the selector member when the selector member is in the priming position.

2. The carburetor set forth in claim 1 further comprising a fuel draw check valve arranged and constructed within the fuel draw passage, the fuel draw check valve allowing fuel to flow only from the fuel chamber to the pump chamber.

3. The carburetor set forth in claim 2 wherein the priming pump has an encasement engaged between the priming bulb and the seat, the member being in slideable contact between the seat and the encasement.

4. The carburetor set forth in claim 3 wherein the selector member is a rotating disk.

5. The carburetor set forth in claim 4 wherein the encasement has a circumferential wall projecting axially and engaging the seat at a distal edge of the circumferential wall of the encasement, the disk being disposed radially inward from the circumferential wall of the encasement.

6. The carburetor set forth in claim 5 further comprising:

the circumferential wall defining a slot extended circumferentially; and the rotating disk having a tab projecting radially outward through the slot of the circumferential wall.

7. The carburetor set forth in claim 6 wherein the rotating disk has a shaft projecting concentrically through both sides of the disk, and wherein one end of the shaft is disposed rotatably in a bore defined by the seat and the other end of the shaft is disposed rotatably in a bore defined by the encasement.

8. The carburetor set forth in claim 7 further comprising:

the disk having an inward side and an opposite outward side; and an inward gasket disposed axially between the seat and the disk, the inward gasket being engaged stationary to the seat and being in slideable and sealable contact with the inward side of the disk, the shaft extending through the inward gasket.

9. The carburetor set forth in claim 8 wherein the priming pump has an outward gasket disposed axially between the disk and the encasement and disposed radially inward from the circumferential wall of the encasement, and wherein the outward gasket is engaged stationary to the encasement and is in slideable and sealable contact with the outward side of the disk, and the shaft being extended through the outward gasket.

10. The carburetor body set forth in claim 9 wherein the seat is defined by an exterior surface of the carburetor body.

11. The carburetor set forth in claim 9 wherein the seat is defined by the air cleaner.

12. The carburetor set forth in claim 2 wherein the carburetor body defines a vent passage communicating between an upper air dome portion of the fuel chamber and the atmosphere.

13. The carburetor set forth in claim 12 further comprising:

the vent passage having a reduction orifice;

the selector member defining an air prime orifice communicating axially through the selector member; and an air prime passage defined by the carburetor body, the air prime passage communicating between the fuel chamber and the pump chamber when the air prime orifice is aligned to the air prime passage and the selector member is in the priming position, wherein a flow cross section of the vent passage is substantially larger than a flow cross section of the air reduction orifice.

14. The carburetor set forth in claim 12 wherein the vent passage has a normally closed vent check valve.

15. The carburetor set forth in claim 13 wherein the air prime passage communicates directly between the vent passage and the pump chamber when the selector member is in the priming position.

16. The carburetor set forth in claim 15 wherein the selector member is a rotatable disk.

17. The carburetor set forth in claim 16 further comprising a main fuel feed passage communicating between the lower portion of the fuel chamber and the fuel-and-air mixing passage.

18. The carburetor body set forth in claim 9 wherein the seat is defined by an exterior surface of the carburetor body.

19. The carburetor set forth in claim 9 wherein the seat is defined by the air cleaner.

20. The carburetor set forth in claim 3 further comprising:

a fuel prime passage communicating between the pump chamber and the fuel-and-air mixing passage;

the selector member defining a fuel prime orifice communicating axially through the selector member, the fuel prime orifice being aligned to the fuel prime passage and the fuel-in orifice being aligned to the fuel draw passage when the selector member is in the priming position; and a fuel prime check valve disposed within the fuel prime passage allowing fuel to flow from the pump chamber into the fuel-and-air mixing passage and preventing reverse flow.

21. The carburetor set forth in claim 20 wherein the fuel prime check valve is a spring assisted check valve.

22. The carburetor set forth in claim 20 wherein the selector member is a rotating disk.

23. The carburetor set forth in claim 22 further comprising:

the fuel-and-air mixing passage having a venturi disposed between the inlet and outlet; and the fuel prime passage communicating with the fuel-and-air mixing passage substantially near the venturi and between the outlet of the fuel-and-air mixing passage and the venturi.

24. The carburetor set forth in claim 23 wherein the rotating disk has a tab projecting radially outward.

25. The carburetor body set forth in claim 9 wherein the seat is defined by an exterior surface of the carburetor body.

26. The carburetor set forth in claim 23 wherein the rotating disk has a tab projecting radially outward.

27. The carburetor set forth in claim 14 wherein the vent check valve has a ball, a ball seat, a coil spring and a tubular body having a closed end, the ball and the coil spring disposed within the tubular body and axially between the ball seat and the closed end, the ball slideably received within the tubular body and seated against the seat by a biasing force of the coil spring when the vent check valve is closed, the coil spring being engaged between the ball and the closed end.

28. The carburetor set forth in claim 14 wherein the vent check valve has a ball, a ball seat and a tubular portion, the tubular portion communicating with the vent passage at one end and engaged to the ball seat at the other end, the ball disposed slideably within the tubular portion and biased against the ball seat via gravity.

29. A carburetor for an internal combustion engine, the carburetor having a carburetor body defining a fuel-and-air mixing passage extending through the carburetor body from an inlet communicating with near atmospheric conditions to an outlet communicating with a combustion chamber of the engine, the carburetor comprising:

the carburetor body defining a seat and a fuel chamber, the fuel chamber having an upper and a lower portion;

a priming pump engaged to the mating surface of the carburetor body, the priming pump having a pump chamber defined by a resilient priming bulb, a selector member received between the priming bulb and the seat of the carburetor body and constructed and arranged to be movable to a priming position and to a drain position, the selector member having a fuel-in orifice, an air prime orifice, and a drain fuel-out orifice communicating through the selector member;

a fuel draw passage defined by the carburetor body communicating between the lower portion of the fuel chamber and through the seat of the carburetor body, the fuel draw passage being in communication with the pump chamber when the fuel-in orifice is aligned to the fuel draw passage and the selector member is in the drain position;

a drain passage defined by the carburetor body and extending from the seat of the carburetor body to an outlet communicating with atmosphere, the drain passage being in communication with the pump chamber when the drain fuel-out orifice is aligned to the drain passage and the selector member is in the drain position;

a vent passage defined by the carburetor body and communicating between an upper portion of the fuel chamber and the atmosphere;

a main fuel feed passage communicating between the lower portion of the fuel chamber and the fuel-and-air mixing passage; and wherein the drain passage orifice is obstructed by the selector member when the selector member is in the priming position.

30. The carburetor set forth in claim 29 further comprising a fuel draw check valve arranged and constructed within the fuel draw passage, the fuel draw check valve allowing fuel to flow only from the fuel chamber to the pump chamber.

31. The carburetor set forth in claim 30 further comprising an air prime passage defined by the carburetor body and communicating from the fuel chamber and through the seat of the priming pump.

32. The carburetor set forth in claim 30 further comprising a fuel prime passage communicating from the fuel-and-air mixing passage and through the seat of the priming pump.

33. The carburetor set forth in claim 31 wherein the selector member of the fuel pump further comprises:

an air prime orifice through the selector member;

the pump chamber being in communication with the air prime passage when the air prime orifice is aligned to the air prime passage and the selector member is in the priming position;

wherein the fuel draw passage and the fuel drain passage are obstructed from communication with the pump chamber by the selector member when the selector member is in the priming position; and wherein the air prime passage is obstructed from communication with the pump chamber by the selector member when the selector member is in the fuel chamber drain position.

34. The carburetor set forth in claim 33 wherein the air prime passage communicates directly from the vent passage through the air prime orifice to the pump chamber when the selector member is in the priming position.

35. The carburetor set forth in claim 34 wherein the selector member is a rotating disk.

36. The carburetor set forth in claim 30 wherein the vent passage has a reduction orifice exposed to atmosphere.

37. The carburetor set forth in claim 36 wherein a flow cross section of the air prime passage and the vent passage is substantially larger than a flow cross section of the reduction orifice.

38. The carburetor set forth in claim 35 wherein the vent passage has a normally closed vent check valve.

39. The carburetor set forth in claim 32 wherein the selector member of the priming pump has a fuel prime orifice through the selector member, the fuel prime orifice being aligned to the fuel prime passage and the fuel-in orifice being aligned to the fuel draw passage when the selector member is in the priming position.

40. The carburetor set forth in claim 39 wherein the fuel-in orifice is one of two fuel-in orifices, the first fuel-in orifice being aligned to the fuel draw passage when the selector member is in the priming position, and the second fuel-in orifice being aligned to the fuel draw passage when the selector member is in the drain position.

41. The carburetor set forth in claim 40 further comprising a fuel prime check valve disposed within the fuel prime passage, the fuel prime check valve constructed and arranged to allow fuel flow from the pump chamber to the fuel-and-air mixing passage and to prevent reverse flow.

42. The carburetor set forth in claim 41 wherein the fuel prime check valve is a spring assisted check valve.

43. The carburetor set forth in claim 42 wherein the selector member is a rotating disk.

44. The carburetor set forth in claim 42 further comprising:

the fuel-and-air mixing passage having a venturi disposed between the inlet and outlet; and the fuel prime passage communicating with the fuel-and-air mixing passage substantially near the venturi and between the outlet and the venturi.

45. The carburetor set forth in claim 29 further comprising a syphon tube carried by the carburetor body and being in communication with the outlet of the drain passage, wherein the syphon tube extends below the fuel chamber to promote siphoning.

* * * * *